US011760546B2

(12) United States Patent
Lutz et al.

(10) Patent No.: US 11,760,546 B2
(45) Date of Patent: Sep. 19, 2023

(54) SYSTEMS AND METHODS FOR DE-OXYGENATION OF A CLOSED CONTAINER

(71) Applicants: Thomas R. Lutz, Cedar Rapids, IA (US); Michelle Lutz, Cedar Rapids, IA (US)

(72) Inventors: Thomas R. Lutz, Cedar Rapids, IA (US); Michelle Lutz, Cedar Rapids, IA (US)

( * ) Notice: Subject to any disclaimer, the term of this patent is extended or adjusted under 35 U.S.C. 154(b) by 126 days.

(21) Appl. No.: 17/268,153

(22) PCT Filed: Aug. 13, 2019

(86) PCT No.: PCT/US2019/046324

§ 371 (c)(1),
(2) Date: Feb. 12, 2021

(87) PCT Pub. No.: WO2020/036945

PCT Pub. Date: Feb. 20, 2020

(65) Prior Publication Data

US 2021/0198019 A1 Jul. 1, 2021

Related U.S. Application Data

(60) Provisional application No. 62/718,283, filed on Aug. 13, 2018.

(51) Int. Cl.
*B65D 51/24* (2006.01)
*B65D 39/00* (2006.01)

(52) U.S. Cl.
CPC ..... *B65D 51/244* (2013.01); *B65D 39/0076* (2013.01)

(58) Field of Classification Search
CPC ..... B65D 51/244; B65D 39/0076; B65D 39/0052
See application file for complete search history.

(56) References Cited

U.S. PATENT DOCUMENTS

| | | | | |
|---|---|---|---|---|
| 9,452,875 | B2 | 9/2016 | Jepson | |
| 9,944,442 | B2 * | 4/2018 | Carsello | B65D 47/06 |
| 11,001,424 | B2 * | 5/2021 | Luzaich | B65D 39/0076 |
| 2007/0246468 | A1 * | 10/2007 | Miller | F16L 55/1141 220/802 |
| 2008/0272085 | A1 * | 11/2008 | Laporta | B65D 39/0064 215/358 |
| 2012/0048825 | A1 * | 3/2012 | Averett | B65B 51/227 53/471 |
| 2015/0060389 | A1 | 3/2015 | Bolger | |

FOREIGN PATENT DOCUMENTS

| | | |
|---|---|---|
| WO | WO2018075900 | 4/2018 |

OTHER PUBLICATIONS

International Search Report and Written Opinion for PCT/US2019/046324 dated Nov. 13, 2019.

* cited by examiner

*Primary Examiner* — Shawn M Braden
(74) *Attorney, Agent, or Firm* — Patterson Thuente, P.A.

(57) ABSTRACT

A de-oxygenation stopper configured to enable aging of an oxygen sensitive material such as wine contained within a vessel, while minimizing oxygen content within the vessel. The stopper includes an oxygen scavenging element configured to remove and/or neutralize oxygen molecules within the vessel, and a sealing element formed of one or more materials having tailored oxygen transmission rate(s) configured to enable the material to age at a desired rate.

17 Claims, 5 Drawing Sheets

SYSTEMS AND METHODS FOR DE-OXYGENATION OF A CLOSED CONTAINER

TECHNICAL FIELD

The present disclosure relates generally to food and beverage accessories, and more particularly to a de-oxygenating bottle or container stopper, cork, or bung.

BACKGROUND

Certain foodstuffs, liquids, pharmaceuticals, and other substances are sensitive to atmospheric conditions such that exposure to the atmosphere affects shelf life or product quality. For example, while unopened bottles of liquor such as wine or whiskey may last for years, once opened, it may have a limited shelf life before exposure to the environment causes the wine or whiskey to take on a different, often unpleasant taste. For example, it is generally understood that degradation of the wine occurs primarily due to a chemical reaction with oxygen, which in some cases can enable bacterial growth.

To date, various methods and devices have been developed to aid in extending the shelf life of an opened bottle of wine. One preservation method includes applying a low-grade vacuum to the headspace above the wine, thereby removing as much air as possible from the interior of the bottle. Another preservation method includes displacing the volume of consumed wine with an inert material to reduce the headspace above the wine. For example, glass marbles can be placed into the bottle to decrease the headspace. Alternatively, the air within the headspace can be displaced by an inert gas or inflatable bladder. More recently developed preservation systems include a bottle stopper containing a deoxygenation material configured to chemically react with and consume oxygen trapped within the bottle. Such preservation systems are disclosed in PCT Application Nos. PCT/US2017/057605, filed Oct. 20, 2017, and. PCT/US2016/013008 filed Jan. 12, 2016, the contents of which are incorporated by reference herein in their entireties.

While the air displacement and deoxygenation methods have proven effective at extending the shelf life of opened bottles of wine as well as preserving their original tastes and aromaticity, there are various drawbacks ranging from cleaning, appearance and cost. There remains a need for a simpler, cost effective system for preservation of oxygen-sensitive substances, including, but not limited to, wine. The present disclosure addresses this concern.

SUMMARY

According to embodiments, a system for preserving oxygen-sensitive substances, such as, but not limited to wine, includes a sealing device coupleable to a vessel, such as a container, barrel, or bottle, containing the oxygen-sensitive substance to seal the contents from the surrounding atmosphere to limit or inhibit the entry of additional oxygen into the vessel, while, in some instances, an aging process is desired. For sake of simplicity, the preservation of wine is discussed throughout the specification in detail. However, one of ordinary skill in the art would recognize that the systems and methods described herein can be applied to any oxygen-sensitive substance for which preservation or storage is desired. For example, foodstuffs, other liquids, pharmaceuticals or drugs, chemicals, paints, adhesives, or any of a variety of materials can be contemplated.

Embodiments of the disclosure provide a vessel stopper configured to enable the control of oxygen within the vessel, such as for the aging of wine (or other material) contained within the vessel, while minimizing oxygen content within the vessel. The stopper can include one or more oxygen scavenging elements configured to scavenge and remove and/or neutralize oxygen molecules within the vessel, and a sealing element having a desired oxygen transmission rate configured to either control the transmission of oxygen into the vessel such as to enable wine to age at a desired rate, or to inhibit the transmission of oxygen into the vessel altogether.

In one embodiment, the sealing element can be configured as a standard sized stopper for corking a bottle. In another embodiment, the sealing element can be configured as a standard size bung or stopper for at least one of a cask, keg, or barrel. In one embodiment, the oxygen scavenging element can be positioned in a cavity formed within and at least partially surrounded by the sealing element. In one embodiment, the oxygen scavenging element can be operably coupled to the sealing element at a first end of the stopper, for occasional contact with the wine. In one embodiment, the oxygen scavenging element can be a sachet or pouch constructed of material configured to inhibit the absorption and/or transmission of liquid therethrough, and an oxygen scavenging material can be encapsulated within the material.

In embodiments, synthetic and/or natural materials can be used for the sealing device. For example, natural material can include natural or plant based polymers, natural cork, and/or natural rubber, either alone or in combination with a synthetic material. Synthetic materials can include polymers, plastics, hydrogels, synthetic cork, synthetic rubber, or combinations thereof. In some embodiments, a recyclable material, such as plant based materials or other polymers, can be contemplated such that the device is completely recyclable. In embodiments, the material(s) selected for the sealing device are selected and tailored to desired oxygen transmission rates.

In an embodiment, the sealing element can include a first portion having a first oxygen transmission rate, and a second portion having a second oxygen transmission rate less than the first oxygen transmission rate. In one embodiment, the second portion can be configured to inhibit the passage and/or absorption of oxygen molecules, while the first portion allows some transmission of oxygen. In one embodiment, the oxygen scavenging element can be positioned at least partially within the first portion and oxygen is able to transmit through the first portion to be scavenged by the oxygen scavenging element. In one embodiment, the oxygen scavenging element can be positioned at least partially within both the first portion and the second portion.

In one embodiment, the sealing element includes a sidewall and cap, thereby defining an interior chamber or cavity into which the oxygen scavenging element can be positioned. In one embodiment, the sealing element can include one or more sealing ribs configured to enhance sealing between the sealing element in the vessel.

In embodiments, the oxygen scavenging element is configured to be removed and optionally replaced with a new oxygen scavenging element without the need to replace the entire stopper, and/or without the need to remove the stopper from the vessel to which it is coupled. For example, a portion of the stopper can be configured to be removed, opened, or otherwise accessible such that a first oxygen scavenging element, such as a satchel containing an oxygen scavenging material, can be removed and replaced with a second oxygen scavenging element.

The above summary of the invention is not intended to describe each illustrated embodiment or every implementation of the present invention. The detailed description and claims that follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1A:
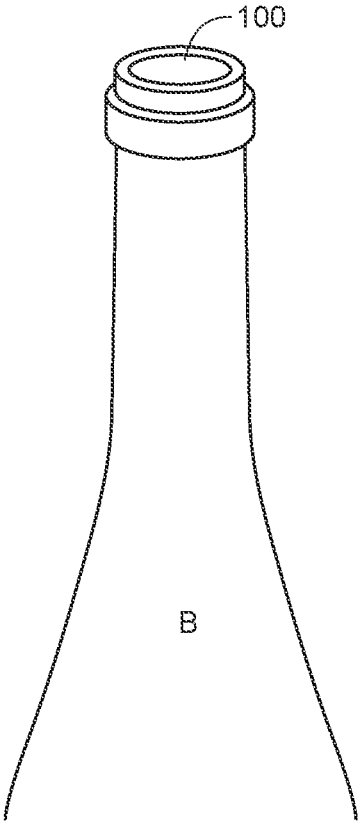
FIG. 1A is a perspective view depicting a sealing device positioned within the opening of a wine bottle, in accordance with a first embodiment of the disclosure.

While embodiments are amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

Figure 1B:
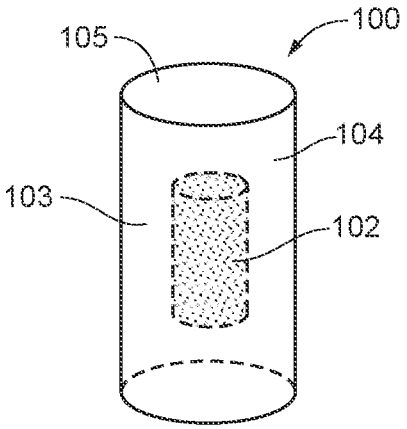
FIG. 1B is a perspective view depicting the sealing device of FIG. 1A.

Referring to FIGS. 1A and 1B, a first embodiment of a sealing device 100 is depicted in accordance with the disclosure. In one embodiment, the sealing device 100 can be shaped and sized to be inserted into the opening of a bottle B of a conventional size and shape, such that the sealing device 100 closely approximates the dimensions of a standard stopper. For example, the sealing device 100 can be substantially cylindrical in nature, can have a diameter of between ⅞ and 15/16 inches, and a length of between 1.5 and 2.25 inches. In one embodiment, the sealing device 100 can be configured as a standard size #7, #8, #9, or #10 stopper known to one of ordinary skill in the art. Other shapes and sizes of sealing device 100 are also contemplated, such as, for example, a frustoconical shape. Accordingly, the sealing device 100 can be utilized in place of a conventional wood or rubber cork in the wine bottling process, as well as in the re-corking of an opened bottle of wine.

In one embodiment, the sealing device 100 can include a sealing element 104 containing an oxygen scavenging element 102 positioned within the sealing element 104 in an internal cavity defined by the sidewall 103 and the top surface or cap 105 positioned at a top end of the sidewall 103 of the sealing element 104. A bottom surface, if present, can be formed of a permeable material or membrane and/or can be eliminated altogether, and the headspace in the bottle is in fluidic contact with the oxygen scavenging element 102. Optionally, a temporary seal can be placed on the bottom of the sealing device 100, and then removed upon use.

The oxygen scavenging element 102 can be formed of a variety of chemistries and technologies that are readily commercially available that can selectively react with oxygen to consume the oxygen. Agents or oxygen absorbers that can be used to de-oxygenate fluids, such a wine, via chemical reaction include, but are not be limited to, metal-based substances that remove oxygen by reacting with it by chemical bonding, generally forming a metal oxide component (e.g. an iron based material such as iron powder with sodium chloride). Metal-based substances include elemental iron as well as iron oxide, iron hydroxide, iron carbide and the like. Other metals for use as oxygen absorbers include nickel, tin, copper, zinc, or combinations thereof. Metal-based oxygen absorbers are typically in the form of a powder to increase surface area, but liquid or larger particle sizes can be contemplated. Other suitable oxygen absorbing material can comprise ascorbic acid, ascorbate such as sodium ascorbate, catechol and phenol, activated carbon and polymeric materials incorporating a resin and a catalyst, ferrous carbonate in conjunction with a metal halide catalyst, sodium hydrogen carbonate, and/or citrus or citric acid.

The most common food-safe technology today is iron-based powder with sodium chloride, which can chemically react with the oxygen to remove it for food packaging. More specifically, when the oxygen absorber comprising iron powder with sodium chloride is removed from protective packaging, the moisture in the surrounding atmosphere begins to permeate into the iron particles. The moisture activates the iron, and it oxidizes to form iron oxide. To assist in the process of oxidation, sodium chloride is added to the mixture, acting as a catalyst or activator, causing the iron powder to be able to oxidize even with relative low humidity. As oxygen is consumed to form iron oxide, the level of oxygen in the surrounding atmosphere is reduced. Absorber technology of this type may reduce the oxygen level in the surrounding atmosphere to below 0.01%. For example, complete oxidation of 1 gram of iron can remove 300 $cm^3$ of oxygen in standard conditions.

In some embodiments, the oxygen scavenging element 102 can comprise a particulate material, a powder, a gel, or a liquid oxygen scavenging agent contained within a capsule or sachet. In other embodiments, the oxygen scavenging element 102 can comprise a particulate or powered oxygen scavenging agent molded, compacted, or otherwise formed into the shape of a capsule, plug, or other desired shape.

As depicted in FIGS. 1A and 1B, in one embodiment, the oxygen scavenging element 102 is at least partially surrounded by, housed within an interior cavity of, and/or otherwise coupled to the sealing element 104. In one embodiment, the sealing element 104 can be constructed of a synthetic and/or natural material having a desired or variable oxygen transmission rate properties. For example, in one embodiment, the material can have an oxygen transmission rate configured to enable the wine to age at a desired rate. In this embodiment, the combination of the sealing element 104 with the oxygen scavenging element 102 can enable the aging of wine while minimizing oxygen content within the bottle. In another embodiment, the material may be selected to inhibit the transmission of oxygen altogether.

In embodiments, suitable materials for constructing the sealing element 104 can include, for example, any of a range of synthetic materials or polymers to natural polymers. Polymers can include, for example, acrylonitrile butadiene styrene (ABS), high density polyethylene (HDPE), low density polyethylene (LDPE), polyethylene terephthalate (PET), polypropylene (PP), oriented (e.g. biaxially) or non-oriented, polybutadiene Styrene (PBS), polycarbonate (PC), Polyvinylidene dichloride (PVDC), polylactic acid (PLA), oriented Nylon (e.g. biaxially), ethylene vinyl alcohol (EVOH), or combinations thereof. In embodiments, the oxygen transmission rate is tailorable for its intended end use. For example, polar polymers such as PC, oriented Nylon, EVOH, polycarbonate, and others have a low oxygen transmission rate compared to nonpolar polymers such as PE, PP, PIB, PVDC. Furthermore, the density and/or crystallinity of the polymer can also be tailored to control oxygen permeability of the material. For example, low density polyethylene (LDPE) has a much higher permeability to oxygen than high density polyethylene (HDPE). In some embodiments, all or part of the stopper is formed of recyclable material(s) such that the entire stopper or portions thereof are recyclable. In certain embodiments, the stopper is formed of one or more bioplastics, such as polylactic acid.

Figure 2A:
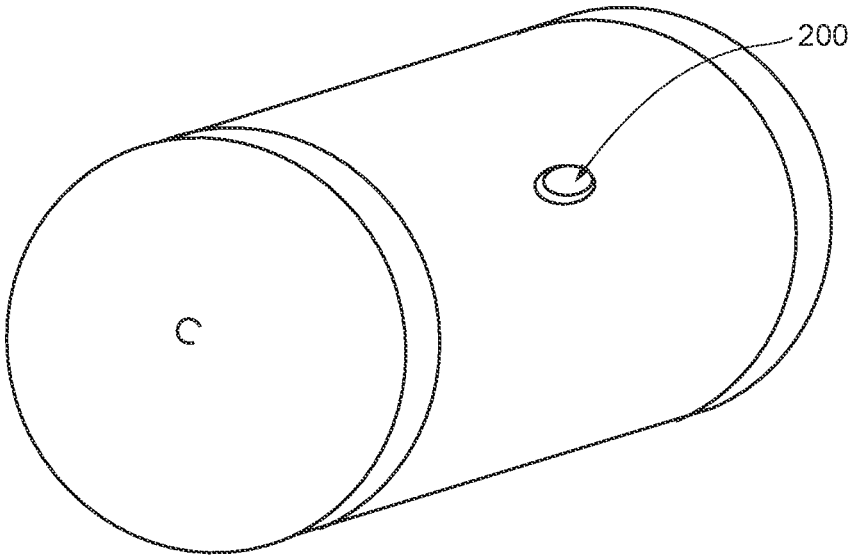
FIG. 2A is a perspective view depicting a sealing device positioned within the opening of a wine barrel, in accordance with a second embodiment of the disclosure.
Figure 2B:
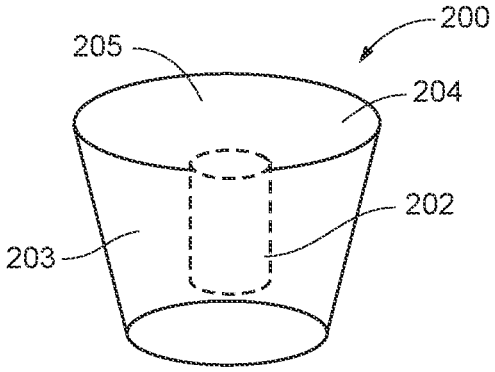
FIG. 2B is a perspective view depicting the sealing device of FIG. 2A.

Referring to FIGS. 2A and 2B, a second embodiment of a sealing device 200 is depicted in accordance with the disclosure. The sealing device 200 can be shaped and sized to be inserted into the bunghole or opening of a cask, keg, or barrel C. Like the previous embodiment, the sealing device 200 can include an oxygen scavenging element 202 and a sealing element 204 with sidewall 203 and top surface 205, and having a tailored oxygen transmission rate. In one embodiment, the sealing element 204 can be substantially frustoconical in shape, thereby enabling the sealing device 200 to provide sealing contact with the opening of the barrel. Accordingly, as above, the combination of the sealing element 204 with the oxygen scavenging element can enable the aging of liquid within the barrel, while minimizing oxygen content within the barrel. In another embodiment, the material of the sealing element 204 may be selected to inhibit the transmission of oxygen altogether.

Figure 3:
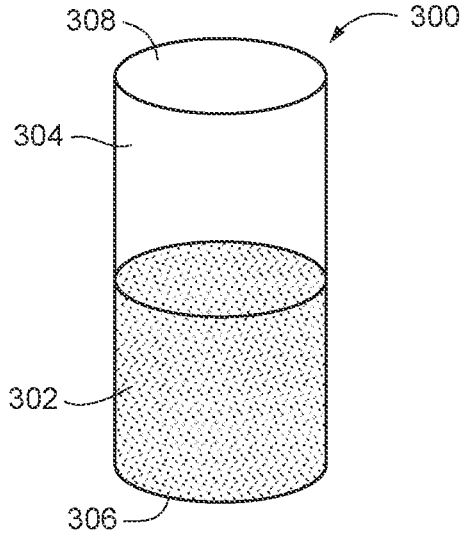
FIG. 3 is a perspective view depicting a sealing device in accordance with a third embodiment of the disclosure.

Referring to FIG. 3, a third embodiment of the sealing device 300 is depicted in accordance with the disclosure. Like previous embodiments, the sealing device 300 can be shaped and sized to be inserted into the opening and/or bung of a vessel or container containing an oxygen sensitive liquid. The sealing device 300 can include a oxygen scavenging element 302 as described above, and a sealing element 304. In one embodiment, the sealing device 300 can be substantially cylindrical or frustoconical in shape; although other shapes are also contemplated. The sealing device 300 can include a first end 306 and a second end 308. In one embodiment, the first end 306 can be configured to be inserted first into the opening and/or bung of the vessel, such that the first end 306 can make occasional contact with the sealed liquid therewithin.

In one embodiment, the oxygen scavenging element 302 can be positioned in proximity to the first end 306, while the sealing element 304 can be positioned in proximity to the second end 308. For example, in one non-limiting embodiment, the oxygen scavenging element 302 can comprise approximately half of the sealing device 300, while the sealing element 304 comprises the other half of the sealing element 300, although other proportions are also contemplated. In one embodiment, the sealing element 304 can have desirable oxygen transmission rate properties, so as to enable wine contained within the vessel to age at a desirable rate while minimizing oxygen content within the bottle, or can inhibit the transmission of oxygen altogether. In some embodiments, the oxygen scavenging element 302 can be configured to enable the absorption of the gas, such as oxygen, while inhibiting the absorption and/or passage of liquid, such as wine. Accordingly, embodiments of the present disclosure enable the vessel to be stored on its side, such that the wine (or other fluid within the vessel) is in fluid contact with the sealing device 300.

Figure 4A:
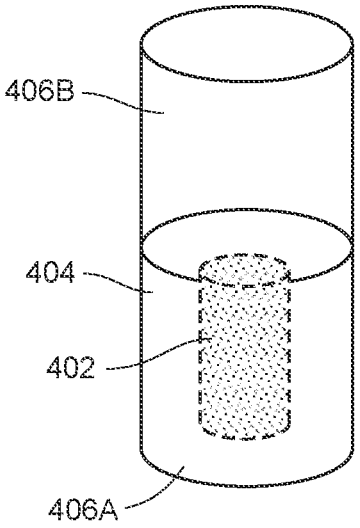
FIG. 4A is a perspective view depicting a first version of sealing device in accordance with a fourth embodiment of the disclosure.
Figure 4B:
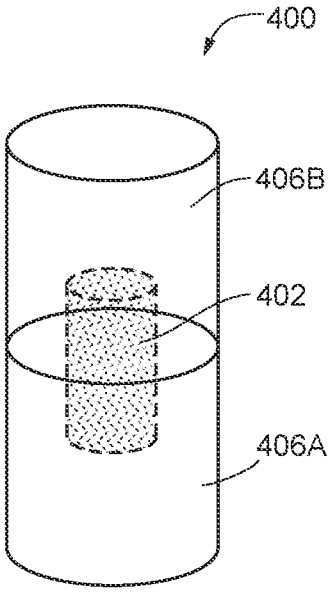
FIG. 4B is a perspective view depicting a second version of sealing device in accordance with a fourth embodiment of the disclosure.

Referring to FIGS. 4A and 4B, a fourth embodiment of the sealing device 400 is depicted in accordance with the disclosure. Like previous embodiments, the sealing device 400 can be shaped and sized to be inserted into the opening and/or bunghole of a vessel or container containing an oxygen sensitive liquid. The sealing device 400 can include an oxygen scavenging element 402 as described above, and a two-part sealing element 404. The two-part sealing element 404 can include a first element 406A and a second element 406B; although a sealing element 400 having greater than two parts is also contemplated. In one embodiment, the first element can be configured to be inserted first into the opening of the vessel, such that the first element 406A can make occasional contact with the sealed liquid therewithin.

In one embodiment, the first element 406A can have a first oxygen transmission rate property, and the second element 406B can have a second oxygen transmission rate property less than the first oxygen transmission rate property. For example, in one embodiment, the first element 406A can be constructed of an oxygen permeable material such as those materials listed above with higher oxygen transmission rates, while the second element 406B can be constructed of a substantially impermeable oxygen material such as those materials listed above with low oxygen transmission rates, thereby inhibiting the passage of oxygen molecules therethrough.

The oxygen scavenging element 402 can be at least partially surrounded by, housed within a portion of, and/or operably coupled to the two-part sealing element 404. For example, in one embodiment, the oxygen scavenging element 402 can be positioned internally the oxygen permeable first element 406A (as depicted in FIG. 4A). In another embodiment, the oxygen scavenging element 402 can be partially positioned internally within the oxygen permeable first element 406A and partially positioned within the non-oxygen permeable second element 406B. Accordingly, combination of the two-part sealing element 404 with the oxygen scavenging element 402 can enable the aging of liquid contained within the sealed vessel while the minimizing oxygen content within the sealed vessel.

Figure 5:
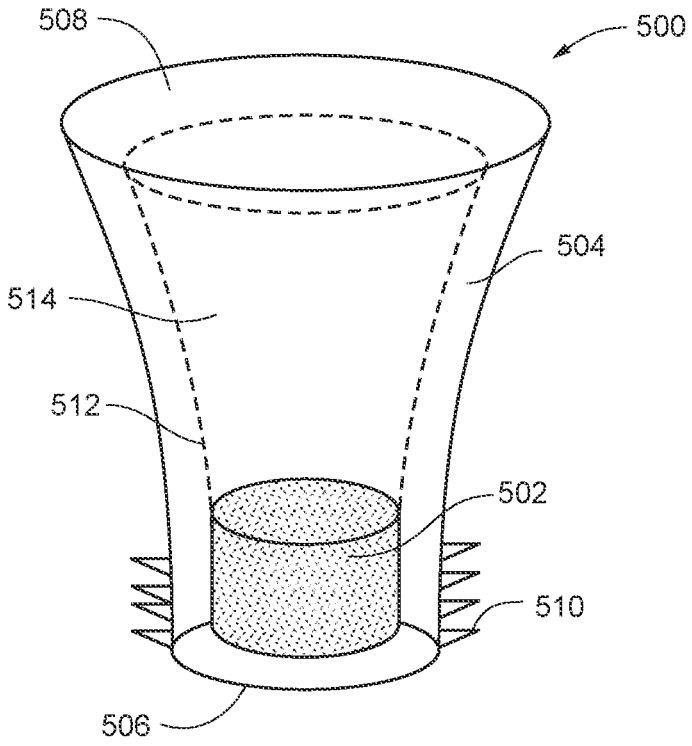
FIG. 5 is a perspective view depicting a sealing device in accordance with a fifth embodiment of the disclosure.

Referring to FIG. 5, a fifth embodiment of the sealing device 500 is depicted in accordance with the disclosure. In one embodiment, the sealing device 500 can be shaped and sized to be at least partially insertable within the opening of a vessel containing an oxygen sensitive substance. The sealing device 500 can include an oxygen scavenging element 502 as described above, and a sealing element 504. The sealing device 500 can include a first end 506 and a second end 508. In one embodiment, the first end 506 can be configured to be inserted first into the opening of the vessel, such that the first end 506 can make occasional contact with the sealed liquid therewithin. In some embodiments, the oxygen scavenging element 502 can be configured to enable the absorption of the gas, such as oxygen, while inhibiting the absorption and/or passage of liquid, such as wine. Accordingly, embodiments of the present disclosure enable the vessel to be stored on its side, such that the wine (or other fluid within the vessel) is in fluid contact with the sealing device 500.

In one embodiment, the sealing element 504 can define one or more sealing ribs 510 configured to promote sealing between the sealing element 504 and the opening of the vessel. The oxygen scavenging element 502 can be at least partially surrounded by, housed within a portion of, and/or operably coupled to the two-part sealing element 504. In one embodiment, the sealing element 504 can define a chamber 512 into which the oxygen scavenging element 502 can be positioned. In one embodiment, a sealed void 514 defined within the sealing element proximal to the second end 508 can be established upon positioning of the oxygen scavenging element 502 within the chamber 512. In other embodiments, the void 514 can be completely filled with the oxygen scavenging element 502.

In one embodiment, the sealing element 504 can be constructed of a synthetic material having variable oxygen transmission rate properties. For example, in one embodiment, the synthetic material can have an oxygen transmission rate configured to enable the wine to age at a desired rate, or can inhibit the transmission of oxygen altogether. Combination of the sealing element 504 with the oxygen scavenging element 502 can enable the aging of wine while minimizing oxygen content within the bottle.

Any or all of the embodiments above can be configured such that the oxygen scavenging element is replaceable without the need to replace the entire stopper, and/or without the need to remove the stopper from the container to which it is coupled. For example, the stopper can include an air tight hinged cover, threaded cap or cover, snap fit cap, or otherwise removable top portion to provide access to the otherwise encased oxygen scavenging element. Once the oxygen scavenging element has been consumed or otherwise exhausted, the oxygen scavenging element can be removed from the stopper, and can be replaced with a new oxygen scavenging element.

In one exemplary embodiment, such as the embodiment of FIGS. 4A and 4B, first portion 406A can be removably coupled to second portion 406B, such as by threaded engagement, such that oxygen scavenging agent 402 can be removed and replaced. in another example, second end 508 can comprises a hinged or snap fitted cap, that when opened, access to void 514 allows element 502 to be removed and replaced.

Figure 6:
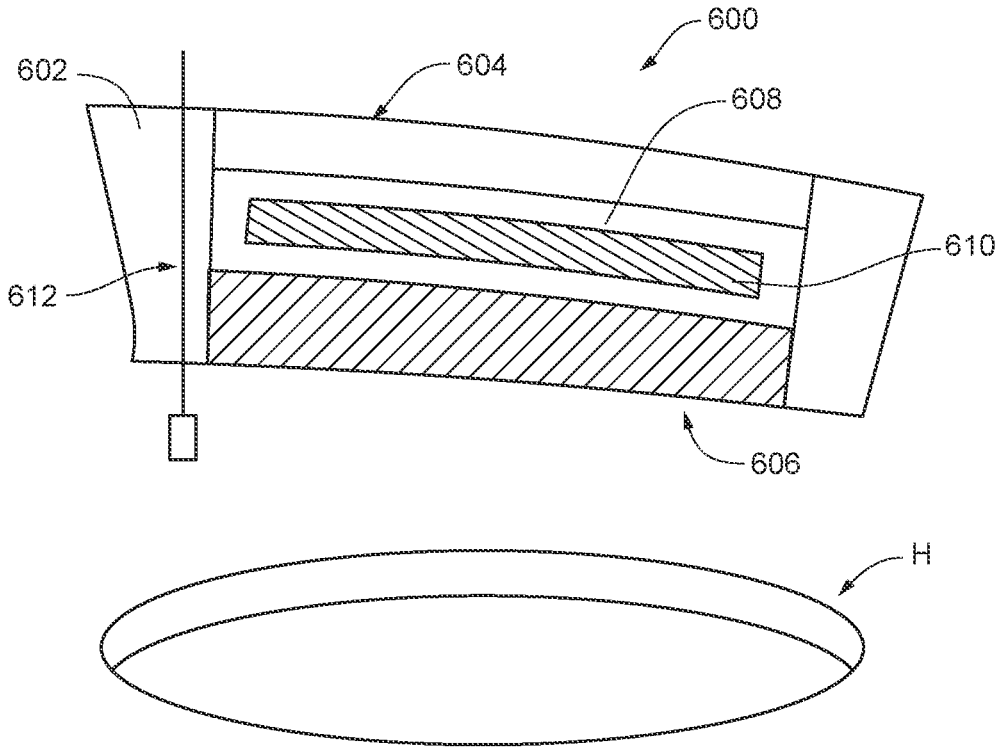
FIG. 6 is a cross-section front elevational view of a sealing device in accordance with a sixth embodiment of the disclosure.

In another exemplary embodiment, depicted in FIG. 6, a sealing device 600, such as a bung, includes a sidewall 602 sized to fit a standard opening such as a bung or barrel hole H. A removable airtight cap 604 is coupled to a top portion of sidewall 602, while a porous or oxygen permeable material 606 such as cork or a membrane seals a bottom portion of sidewall 602, thereby defining an oxygen absorbing cavity 608. The cap 604 and sidewall 602 are formed of non-oxygen transmitting material, such as the material listed above, and can optionally include one or more sealing rib(s) or other sealing mechanisms to seal the barrel.

The oxygen absorbing or scavenging element 610, as described with respect to other embodiments, is encapsulated within cavity 608. Oxygen from the barrel is transmitted through the porous material 606 and into the cavity 608 where it is absorbed by the oxygen scavenging agent of the oxygen scavenging element 610. Once the oxygen absorbing or scavenging element 610 has been expended, cap 604 is removed, element 610 is removed, and a new oxygen scavenging element 610 is placed within cavity 608. The cap 604 is then replaced. Alternatively, the probe 612 can be placed within the cavity 608, and when a certain level of oxygen is detected within the cavity 608, it is determined that the scavenging element 610 should be replaced.

In embodiments, an optional probe 612, can extend permanently or removably through a portion of the device 600, such as through the sidewall 602 as depicted, and is configured to measure the oxygen level within the airspace or headspace of the barrel, without the need to remove the device 600. In alternative embodiments, other detection elements can be incorporated. For example, the oxygen scavenging element 610 can include a color indicator or other indicator to indicate when it has been expended and needs to be replaced. In this embodiment, the cap 604 is optionally formed of a transparent or translucent material so that a visual indicator of the element 610 is viewable without the need to remove cap 604.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

What is claimed is:

1. A stopper for sealing an opening of a material-containing vessel, the stopper being configured to minimize an oxygen content within the vessel, the stopper comprising:

a sealing element having an oxygen transmission rate, the sealing element being configured to seal an opening of a vessel; and an oxygen scavenging element contained within an interior of the sealing element, the oxygen scavenging element configured to scavenge oxygen from a headspace of the vessel, wherein the sealing element comprises a sidewall and a cap positioned at a top end of the sidewall, the sidewall and cap being formed of an oxygen impermeable material and defining an interior cavity, wherein the oxygen scavenging element is contained within the interior cavity, wherein an oxygen permeable material is positioned at a bottom end of the sidewall to seal the oxygen scavenging element within the interior cavity, wherein the cap is configured to be removed to access an interior cavity of the sealing element for removal and replacement of the oxygen scavenging element without removing the stopper from the vessel, wherein the stopper further includes an indicator configured to detect a level of oxygen within the vessel and indicate when the oxygen scavenging element should be replaced, and wherein the indicator is a probe which extends within a headspace of the vessel.

2. The stopper of claim 1, wherein sealing element is configured as a cork for at least one of a cask, keg or barrel.

3. The stopper of claim 1, wherein the oxygen scavenging element is at least partially surrounded by the sealing element.

4. The stopper of claim 1, wherein the oxygen scavenging element is operably coupled to the sealing element at a first end of the stopper, and is configured for occasional contact with the material contained within the vessel.

5. The stopper of claim 1, wherein the sealing element is formed of a material configured to inhibit the absorption and/or transmission of liquid therethrough.

6. The stopper of claim 1, wherein the sealing element includes a first portion having a first oxygen transmission rate, and a second portion having a second oxygen transmission rate wherein the first oxygen transmission rate is greater than the second oxygen transmission rate.

7. The stopper of claim 6, wherein the second portion is configured to inhibit the passage therethrough and/or absorption therein of oxygen molecules.

8. The stopper of claim 6, wherein the oxygen scavenging element is positioned at least partially within the first portion.

9. The stopper of claim 6, wherein the oxygen scavenging element is positioned at least partially within both the first portion and the second portion.

10. The stopper of claim 1, wherein the sealing element includes a sidewall and a top surface defining a chamber into which the oxygen scavenging element is positioned.

11. The stopper of claim 1, wherein the stopper includes structure defining one or more sealing ribs formed of on an outer surface of the sealing element, the one or more sealing ribs being configured to enhance sealing between the sealing element and the vessel.

12. The stopper of claim 1, wherein the stopper is configured to seal the vessel such that when the stopper is in a horizontal storage position, the material contained within the vessel stays within the vessel.

13. The stopper of claim 1, wherein the indicator comprises a material that is configured to change color depending on the level of oxygen present.

14. The stopper of claim 13, wherein the material forms a sachet containing an oxygen scavenging material, the sachet being positioned in the interior cavity.

15. The stopper of claim 14, wherein the cap is formed of a transparent or translucent material such that a color of the sachet is viewable without removing the cap.

16. The stopper of claim 1, wherein the sealing element is formed from a material selected from the group consisting of acrylonitrile butadiene styrene (ABS), high density polyethylene (HDPE), low density polyethylene (LDPE), polyethylene terephthalate (PET), polypropylene, polybutadiene styrene (PBS), polycarbonate (PC), Polyvinylidene dichloride (PVDC), polylactic acid (PLA), nylon, ethylene vinyl alcohol (EVOH), and combinations thereof.

17. The stopper of claim 6, the first portion having a first oxygen transmission rate comprises low density polyethylene (LDPE), polyethylene terephthalate (PET), polypropylene, or combinations thereof.

* * * * *